United States Patent [19]

Chateauneuf et al.

[11] 3,955,237

[45] May 11, 1976

[54] COMBINATION CONVERSION AND STORAGE KIT FOR UPRIGHT VACUUM CLEANERS

[75] Inventors: Robert Chateauneuf, St. Jean; Roger Ross, Mont St-Gregoire, both of Canada

[73] Assignee: The Singer Company, New York, N.Y.

[22] Filed: May 14, 1975

[21] Appl. No.: 577,381

[52] U.S. Cl. ..... 15/323; 15/336; 15/338

[51] Int. Cl.[2] ..... A47L 9/00

[58] Field of Search ..... 15/323, 336, 338, 337

[56] References Cited

UNITED STATES PATENTS

| | | | |
|---|---|---|---|
| 1,681,624 | 8/1928 | Replogle | 15/323 X |
| 2,450,172 | 9/1948 | Stoner | 15/323 X |
| 2,871,504 | 2/1959 | Gall et al. | 15/338 |
| 2,996,748 | 8/1961 | Gitzendanner | 15/338 |
| 3,872,538 | 3/1975 | Crouser | 15/323 |

*Primary Examiner*—Leonard D. Christian
*Assistant Examiner*—C. K. Moore
*Attorney, Agent, or Firm*—Edward L. Bell; Robert E. Smith; Alan Ruderman

[57] ABSTRACT

A kit for converting an upright vacuum cleaner for use as an above-the-floor cleaner. The kit includes a housing which is removably fitted over the front of the cleaner chassis and includes an air chamber communicating the cleaner nozzle opening with one extremity of a hose. The kit includes a plurality of tabs and bosses on the housing for storing the hose and a plurality of accessory nozzles which are selectively exchangeable on the other extremity of the hose.

3 Claims, 3 Drawing Figures

Fig. 1
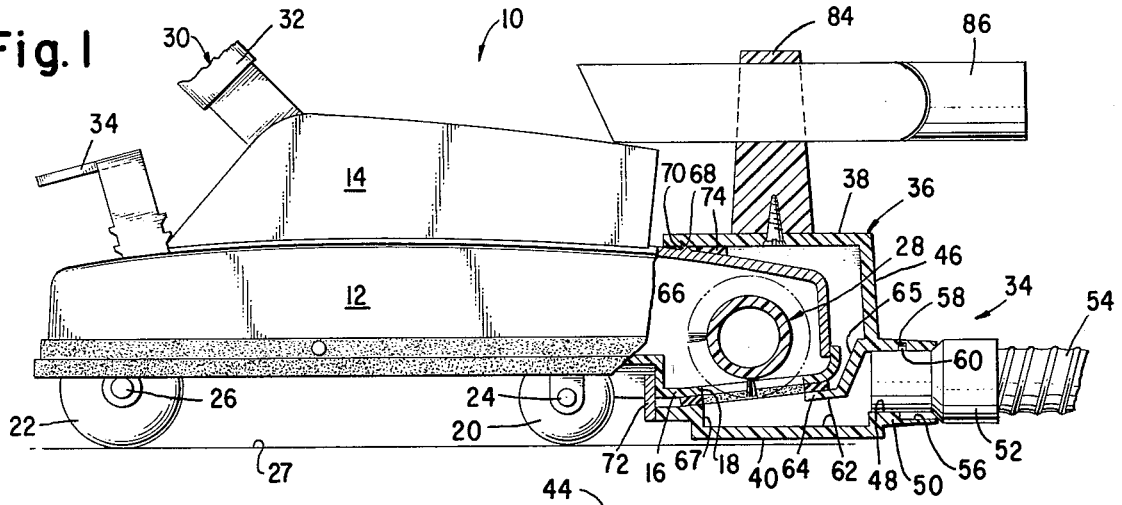
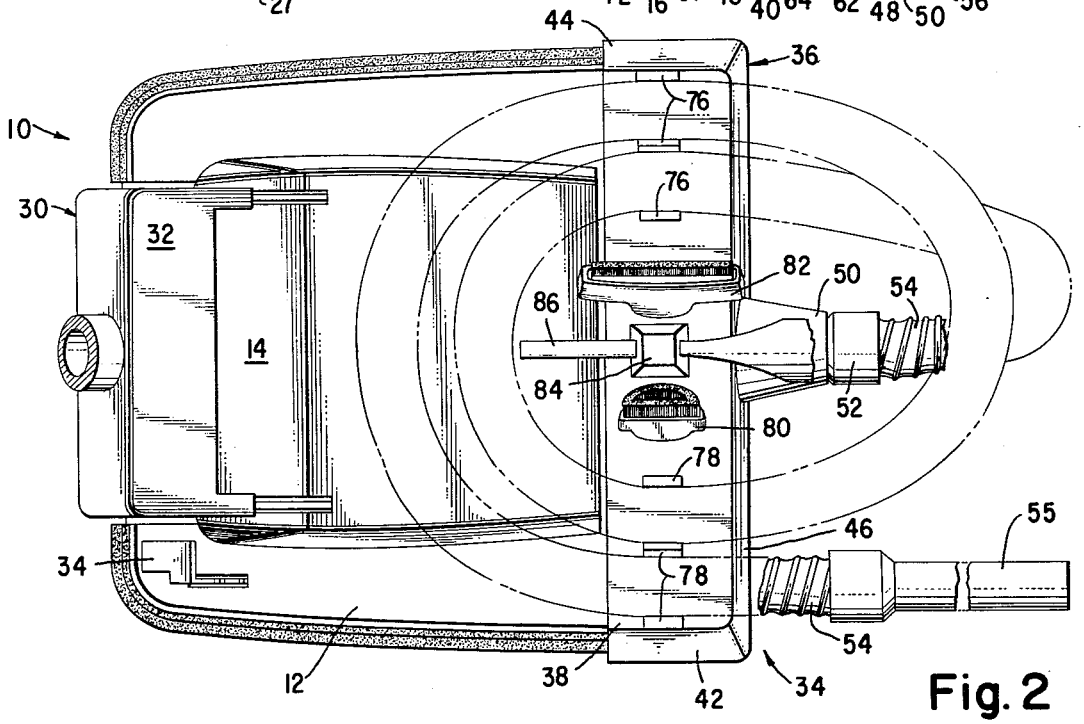
Fig. 2
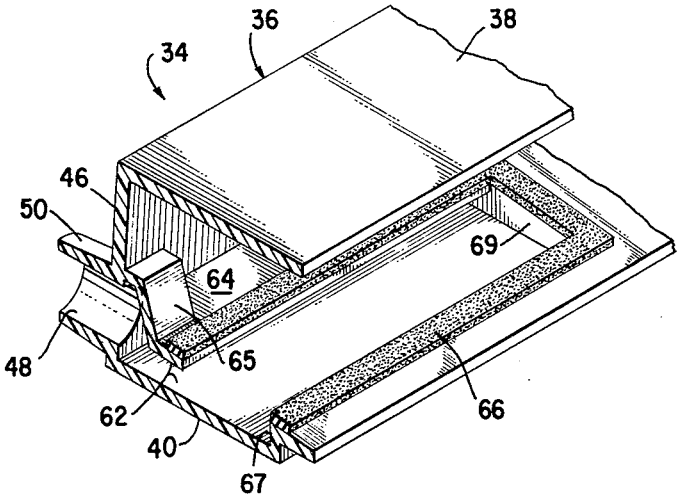
Fig. 3

COMBINATION CONVERSION AND STORAGE KIT FOR UPRIGHT VACUUM CLEANERS

BACKGROUND OF THE INVENTION

This invention relates to vacuum cleaners and more particularly to a kit for adapting upright cleaners for above-the-floor cleaning and for storing above-the-floor cleaning accessories.

Vacuum cleaners of the upright variety generally include a chassis having an elongated nozzle or opening at the bottom thereof through which air is sucked by an air moving motor fan unit, a rotary brush mounted adjacent to the nozzle for contacting a floor surface to agitate and loosen the dirt so that it may be sucked free of the surface, wheels for rolling the cleaner on the floor and a handle for guiding and propelling the cleaner. Most common household cleaning chores involve the cleaning of carpeting, and an upright cleaner is best for such usage. However, in those instances where above-the-floor cleaning of such items as furniture, walls, ceilings, and drapery or the like is required, a conventional upright cleaner is useless. The typical vacuum, cleaner for such cleaning is a canister type which includes a hose having one extremity leading to a suction chamber and the other extremity adapted to receive a plurality of interchangeable accessory nozzles.

In order to minimize the need for a household to have these two types of cleaners, the prior art has attempted various approaches of converting one type of cleaner to the use usually reserved to the other type. For example, canister cleaners having means for accepting a power brush attachment for the cleaning of floors is well-known. Moreover, adapters for attachment to an upright vacuum cleaner to convert to above-the-floor cleaning is also known. Examples of the known prior art in this latter area are U.S. Pat. Nos. 1,021,731; 1,184,201; 1,227,142; 1,648,466; 1,673,920; 1,920,621; 2,606,336; 2,871,504; and 2,996,748. The adapters disclosed in each of these prior art patents mount on the bottom of the upright cleaner in underlaying substantially sealed relation with the nozzle mouth to communicate a hose with the cleaner suction chamber. The prior art adapters however have the inconvenience in that the interchangeable accessory nozzles are not readily at hand. Thus, whenever the operator wants to change nozzles, which is quite often during normal off-the-floor cleaning, the operator is inconvenienced by returning to the storage area. Moreover, since they mount under the nozzle they are difficult to install.

SUMMARY OF THE INVENTION

In order to overcome these deficiencies of the prior art adapters the present invention provides a kit that slides onto the upright cleaner chassis to adapt the cleaner for above-the-floor cleaning and also includes means for storing a plurality of accessory nozzles for selected use with a hose. It also includes means for storing the hose when not in use. An accessory nozzle storage caddy is illustrated in U.S. Pat. No. 3,284,834 which is supported on a cleaner chassis. The present invention combines into a kit an accessory nozzle storage means with an adapter for converting upright cleaners for off-the-floor cleaning.

Accordingly, it is therefore a primary object of the present invention to provide a kit for conveniently adapting an upright cleaner for above-the-floor cleaning and for storing the accessories used for above-the-floor cleaning.

BRIEF DESCRIPTION OF THE DRAWINGS

Other objects and advantages of this invention will best be understood upon reading the following detailed description of the invention with the accompanying drawings, in which:

FIG. 1 is a fragmentary side elevational view partly in section of an upright vacuum cleaner supporting the kit of the present invention in operative position thereon;

FIG. 2 is a top plan view of the cleaner and kit illustrated in FIG. 1; and FIG. 3 is a fragmentary perspective view of the kit housing broken away to illustrate the air chamber and ports.

DESCRIPTION OF THE PREFERRED EMBODIMENT

Referring now to the drawing there is illustrated an upright vacuum cleaner 10 including a chassis 12, on the top of which is secured a hood 14. In a conventional manner, a motor and fan impellers (not shown) is mounted in the chassis below the hood. The cleaner includes an access plate 16 having a nozzle inlet mouth 18 releasably secured to the bottom of the chassis which communicates the dirt laden air with the fan impellers. A cleaner of this type is illustrated in U.S. Pat. Nos. 3,716,185 and 3,163,439 which are assigned to the assignee of the present invention and to which patents reference may be had for a full disclosure of the vacuum cleaner. The fan impellers communicate through a discharge duct between the chassis, the access plate 16 and the hood with a dust bag assembly as illustrated in the aforesaid patents. A pair of front 20 and rear 22 wheels (only one of each pair being illustrated) are respectively mounted on axles 24 and 26 supported on the underside of the chassis to support the cleaner on a floor surface 27. A rotary floor brush assembly 28 is mounted in the nozzle above the mouth 18 so as to contact the floor surface when the cleaner is used as a conventional upright cleaner. Propulsion and manipulation of the cleaner is attained through a handle 30 pivotably connected to the upperside of the chassis by a bifucated bail member 32. The chassis, and thus the nozzle mouth and brush, may be adjusted relative to the floor by means of a lever 34 connected to the rear wheels 22 as disclosed in co-pending U.S. Pat. application Ser. No. 424,510 filed Dec. 13, 1973 and assigned to the assignee of the present application.

In order to convert the upright vacuum cleaner for above-the-floor cleaning and for storing the necessary tools for use therewith, the present invention provides a kit designated generally as 34 and comprising a housing 36. The housing includes exterior top and bottom walls 38 and 40 integrally connected to opposite facing side walls 42 and 44 and a front wall 46. The housing is open at the end opposite the front wall and is sized so as to receive the front of the vacuum cleaner chassis therein. The front wall 46 includes an inlet aperture 48 about which an annular boss 50 is formed for receiving a coupling 52 of a conventional flexible hose 54. The other end of the hose includes a tool receiving coupling 55. Conventionally, the interior of the boss 50 may have a longitudinal notch 56 extending from the front thereof to communicate with an annular groove 58 for receiving a similarly shaped lug 60 on the coupling. The lug is received in the notch 56 and locks the coupling to the boss when forced axially into the groove 58 and given a slight twist in the groove 58.

The inlet aperture 48 opens into an air chamber 62 at the central portion of the housing 36 formed between the bottom wall 40 and a wall 64 spaced above the wall 40 at the front of the housing 36. Behind the inlet 48 the wall 64 includes an oblique downwardly extending baffle portion 65 which directs the air from the inlet into the chamber. At the rear of the housing 36 the bottom wall 40 in the central portion extends upwardly at 67. The walls 64 and 67 extend outwardly at each end from the central portion and merge with thickened wall portions 69 of the bottom wall 40 to enclose the area about the vacuum cleaner nozzle 18 and define an outlet opening substantially coincident with the nozzle. A seal 66 of suitable material is positioned about the walls 64, 67 and 69 between the outlet of the air chamber 62 and the vacuum cleaner nozzle to prevent leakage of air into the nozzle from outside the chamber 62.

The interior of the top wall 38 of the housing 36 may include a notch 68 for receiving a nub 70 formed on the top surface of the cleaner chassis, and the bottom wall 40 may include a pivotable latch 72 for securing the kit on the cleaner chassis in cantilevered fashion with the outlet from the chamber 62 properly sealed with the nozzle 18. A resilient member 74 may be located on the inner surface of the upper wall 38 to dampen vibrations when the cleaner is used with the kit.

The disclosed construction includes a plurality of ribs or tabs 76 and 78 extending upwardly from the top wall 38 on respective sides thereof. The space between each of the ribs 76 and each of the ribs 78 is substantially the same as the diameter of the hose 54 so that the hose can be stored on the housing in a coiled position as illustrated in FIG. 2. Moreover, the top wall 38 includes a plurality of molded bosses of substantially the same diameter as the tool receiving coupling 55 so as to be received within the openings of a plurality of tools or accessory nozzles such as a dusting nozzle 80 and a wall cleaning nozzle 82. A post 84 is secured to or molded to the top wall 38 and includes a slot for receiving the narrow end of a crevice cleaning nozzle 86. Other bosses or posts may be mounted on the wall 38 for mounting additional accessory nozzles so that all the accessories are readily available to an operator when using the upright cleaner for off-the-floor cleaning. Thus, the interchangeable nozzles are conveniently at hand and may be exchanged readily by an operator during off-the-floor cleaning.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what we claim herein is:

1. A kit for adapting an upright vacuum cleaner of the type having a casing formed with a suction opening for above-the-floor cleaning, said kit comprising a housing, means on said housing for storing a flexible hose and a plurality of accessory nozzles selectively exchangeable on one extremity of said hose, said kit housing formed integrally with an air chamber, said air chamber having separate inlet and outlet openings, means for attaching the other extremity of said hose to said inlet opening, and means for supporting the kit on said vacuum cleaner with said outlet opening in sealed communication with the suction opening of said vacuum cleaner so that the air chamber integral with said kit is connected in series between the upright vacuum cleaner and any selected nozzle on said hose.

2. A kit as recited in claim 1 wherein said means for storing the hose and accessory nozzles comprises a plurality of ribs and bosses, said hose being stored in a coiled horizontal condition between adjacent ribs, and said nozzles being stored vertically on respective bosses.

3. A kit as recited in claim 1 wherein a portion of said vacuum cleaner casing is received within said kit housing.

* * * * *